US007278916B2

(12) United States Patent
Boyd et al.

(10) Patent No.: US 7,278,916 B2
(45) Date of Patent: Oct. 9, 2007

(54) GAMING MACHINE HAVING MULTI-ENDED POINTER FOR QUASI-DETERMINISTIC PLAY ("PICK-A-PRIZE")

(75) Inventors: Scott A. Boyd, Las Vegas, NV (US); Miles M. Patceg, Las Vegas, NV (US); Perry O. Cobb, Las Vegas, NV (US); Chris E. Hammond, Las Vegas, NV (US); Kevan L. Wilkins, Las Vegas, NV (US); Shannon L. Mason, Las Vegas, NV (US)

(73) Assignee: IGT, Reno, NV (US)

( * ) Notice: Subject to any disclaimer, the term of this patent is extended or adjusted under 35 U.S.C. 154(b) by 426 days.

(21) Appl. No.: 10/910,755

(22) Filed: Aug. 3, 2004

(65) Prior Publication Data

US 2005/0009595 A1 Jan. 13, 2005

Related U.S. Application Data

(63) Continuation of application No. 10/035,813, filed on Oct. 18, 2001, now Pat. No. 6,793,577.

(51) Int. Cl.
*A63F 9/24* (2006.01)

(52) U.S. Cl. ..... 463/16; 273/141 R; 273/138.1; 273/143 R; 273/121 B; 273/141 A; 463/25; 463/26; 463/27; 463/28; 463/12; 463/13; 463/17; 463/18; 463/19; 463/20; 463/21; 463/22

(58) Field of Classification Search ..... 463/16, 463/27, 20, 13, 42, 12, 17, 18, 19, 21, 22, 463/25, 26, 28; 273/148 R, 292, 141 R, 273/138.1, 143 R, 121 B, 141 A
See application file for complete search history.

(56) References Cited

U.S. PATENT DOCUMENTS 3,222,070 A * 12/1965 Derrington et al. ..... 273/148 R
3,819,186 A * 6/1974 Hinterstocker ..... 463/17
5,259,616 A * 11/1993 Bergmann ..... 463/17
5,292,127 A * 3/1994 Kelly et al. ..... 273/118 A (Continued)

FOREIGN PATENT DOCUMENTS

GB 2201821 A * 9/1988

*Primary Examiner*—Xuan M. Thai
*Assistant Examiner*—Christopher H Bond
(74) *Attorney, Agent, or Firm*—Marger Johnson & McCollom, PC

(57) ABSTRACT

When a special symbol appears during play of the gaming machine game, the secondary game is initiated. At initiation, a bonus prize is determined by the secondary game microcontroller by consulting a bonus game paytable stored therein where each bonus prize corresponds to a bonus spot on the secondary game. A multi-ended pointer of the secondary game spins around the field of bonus spots and the player is prompted to select which end of the pointer is active. Upon selection of the end—e.g. blue or green—a microcontroller operating the spinner calculates the point at which the spinner will cease to spin so that the selected pointed end is pointing toward the selected bonus prize. The player is given the illusion that he or she controls which bonus prize is won since the green side of the pointer will point to a different bonus prize than the blue side.

17 Claims, 4 Drawing Sheets

U.S. PATENT DOCUMENTS 5,584,763 A * 12/1996 Kelly et al. ..... 463/16
5,655,961 A * 8/1997 Acres et al. ..... 463/27
5,788,573 A * 8/1998 Baerlocher et al. ..... 463/16
5,823,874 A * 10/1998 Adams ..... 463/17
5,848,932 A * 12/1998 Adams ..... 463/20
6,142,873 A * 11/2000 Weiss et al. ..... 463/20
6,159,098 A * 12/2000 Slomiany et al. ..... 463/25
6,231,445 B1 * 5/2001 Acres ..... 463/42
6,302,790 B1 * 10/2001 Brossard ..... 463/20
6,319,125 B1 * 11/2001 Acres ..... 463/25
6,336,863 B1 * 1/2002 Baerlocher et al. ..... 463/27
6,364,767 B1 * 4/2002 Brossard et al. ..... 463/20
6,569,015 B1 * 5/2003 Baerlocher et al. ..... 463/16
6,582,303 B1 * 6/2003 Weiss ..... 463/16
6,632,139 B1 * 10/2003 Baerlocher ..... 463/16
6,793,577 B1 * 9/2004 Wilkins et al. ..... 463/16
2002/0193158 A1 * 12/2002 Weiss et al. ..... 463/16
2003/0062678 A1 * 4/2003 Allendorf et al. ..... 273/292
2003/0064797 A1 * 4/2003 Jackson et al. ..... 463/25
2003/0153377 A1 * 8/2003 Lisowski ..... 463/13

* cited by examiner

GAMING MACHINE HAVING MULTI-ENDED POINTER FOR QUASI-DETERMINISTIC PLAY ("PICK-A-PRIZE")

This application is a continuation of U.S. patent application Ser. No. 10/035,813, filed on Oct. 18, 2001, now U.S. Pat. No. 6,793,577, which is herein incorporated by reference in its entirety.

BACKGROUND OF THE INVENTION

This invention relates generally to electronic gaming machines and more particularly to a method and apparatus for integrating a primary and secondary game within a computer network.

Casinos typically include electronic gaming machines (EGMs) such as slot machines and video poker machines. Slot machines, for example, usually include three reels that each have a plurality of symbols printed thereon. After the player applies a wager to the machine, he or she starts play by triggering a switch that starts the reels spinning. Each reel stops at a random position and thereby presents three symbols—one from each reel. Some combinations of symbols do not pay any jackpot. Others pay varying amounts according to predetermined combinations that appear in a pay table displayed on the machine and stored in the gaming machine's programmable read-on memory (PROM).

Competition for players among electronic gaming machines is tight and the industry is developing different methods for attracting and keeping players at their machines. One method for attracting players is to create linked progressive jackpot systems in which multiple gaming machines have been linked together into groups of machines that share the same bonus pool. A simple example of such a system is progressive video poker in which players play the primary poker game on one of a plurality of gaming machines grouped together on the casino floor. A coin-in counter, linked to all machines sharing the progressive pool, counts the total amount of money played in the group of machines and advances the progressive bonus pool accordingly. For instance, the casino can choose to set aside 5% of all money played on the group of video poker machines to the bonus pool. The amount of the pool is displayed on a large LED display and is incremented as money is played. This amount is awarded automatically as a bonus should a player on one of the video poker machines receive a designated winning hand such as a royal flush. After the bonus is awarded, the bonus pool is seeded with a nominal amount that is further incremented as described above.

The advantage of the progressive system is that the bonus pools from individual machines can be pooled to form larger awards that in turn attract more players. When taken to the extreme, progressive bonuses can be pooled together not only from machines in different areas of the casino, but also from different casinos in different states. More complex examples for bonusing are implemented using bonus servers over a network, such as disclosed in co-owned U.S. Pat. No. 6,319,125 (the '125 patent), which is incorporated herein by reference for all purposes. Also incorporated herein by reference for all purposes is U.S. Pat. No. 5,655,961, assigned to the Assignee of the present application (the '961 patent), which also discloses bonuses that can be implemented by bonus servers over a network.

While these linked progressive systems have been effective at drawing additional players, there is a need for gaming machines that have additional attraction features and yet are not required to be linked to other machines.

SUMMARY OF THE INVENTION

The current invention is intended to provide a novel secondary game feature that can be played in addition to the base primary game. The preferred embodiment is described in association with a slot machine, although it is understood that any base game can be used.

The Acres Gaming Pick-A-Prize game includes an upright slot machine, which is the base game, with a top box that includes the bonus game components, including a spinner section and a pair of columns of light cans flanking the spinner. The spinner is preferably mechanical (although it is understood that the spinner can be implemented in lights or other selection means) and includes two pointer ends, a blue end and an opposing green end, that rotate and then stop at one of ten different locations, each having a different numerical value associated with it. The left side of the top box is the "blue" side and includes the blue light can column with multiple bonus prizes, one of which is automatically "selected" after the spinner stops rotating and is awarded as an enhancement to the spinner bonus prize. The right side of the top box is the "green" side and operates similarly to the blue side. The top two positions of each column are shared by both the green and blue side and result, if selected, in an additional bonus prize being awarded.

In operation, when a special symbol appears on one of the base-game reels, the secondary game is initiated. The mechanical spinner begins spinning and the player is prompted to hit either the blue or the green selection button. Pressing one of the color selection buttons causes one column of the light cans flanking the spinner to light up. The choice of colors also determines which end of the spinner is active to yield a particular bonus prize. The player is given the illusion that he or she controls which bonus prize is won since the green side of the pointer will point to a different bonus prize than the blue side. In fact, however, the prize won is determined immediately after the bonus period begins and before the color selection button is pressed based upon a weighted pay table. Only after the color button is pressed is the exact position of the spinner determined. This concept is referred to as quasi-deterministic play.

When the pointer has stopped spinning, the supplementary prize phase begins. Each space of the selected light can column is sequentially highlighted until one is randomly chosen and the appropriate prize (and spinner bonus prize) is awarded to the player. If one of the top two spaces on the column is lit, the bonus amounts from both the green and blue pointer are awarded to the player.

The foregoing and other objects, features and advantages of the invention will become more readily apparent from the following detailed description of a preferred embodiment of the invention that proceeds with reference to the accompanying drawings.

DETAILED DESCRIPTION

Although the gaming machine as described is coupled to a gaming machine network, it is understood that the gaming machine can stand alone whereby the top box secondary game is completely funded by coins or credits played within the primary game. For instance, the secondary game may be funded and thus active only when a maximum bet is made. Alternately, the secondary game may be funded in different amounts by each of the coins or credits played at the base game.

Figure 1:
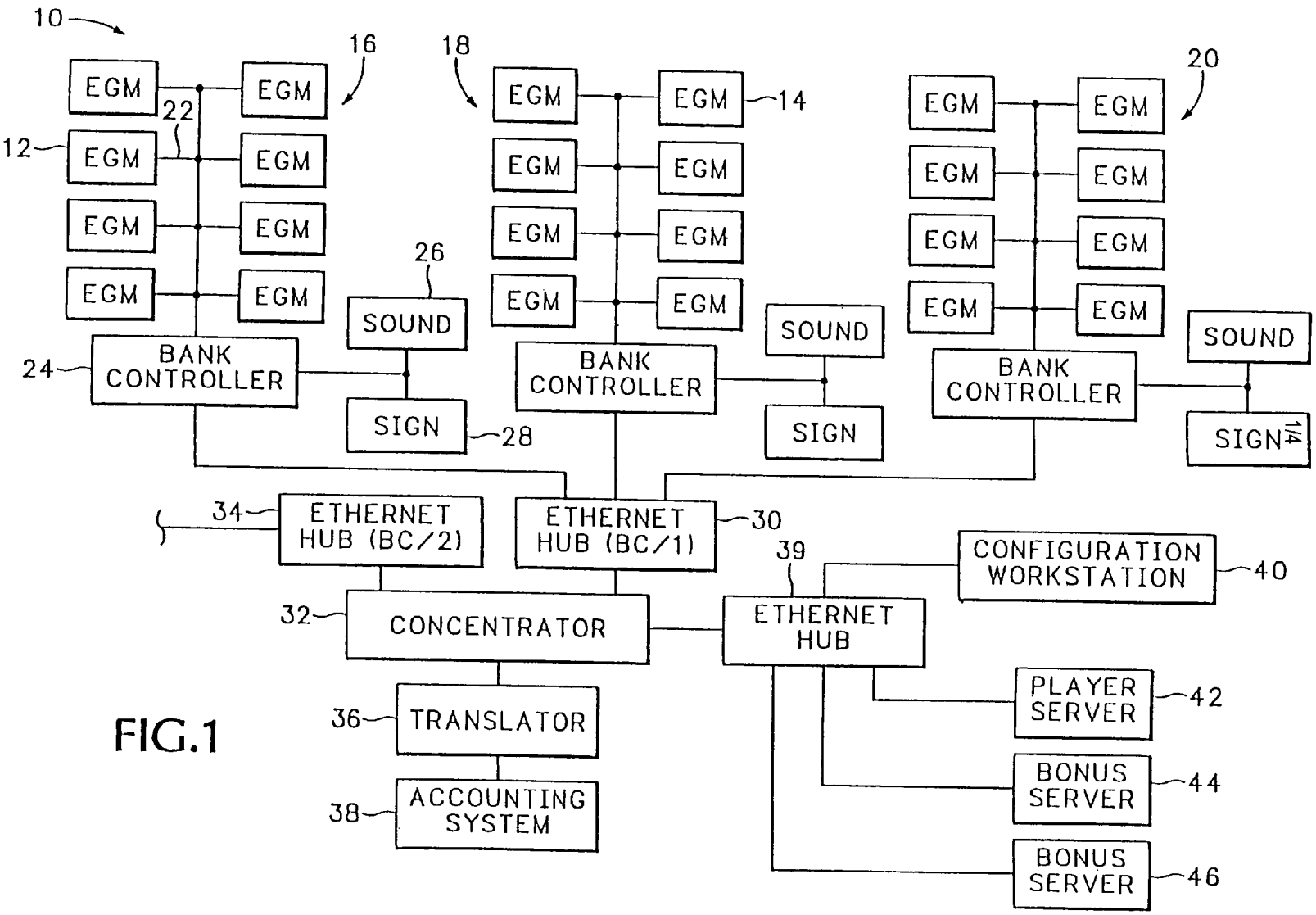
FIG. 1 is a schematic diagram of a plurality of electronic gaming machines interconnected by a computer network to a host computer in accordance with a networked embodiment of the present invention.

Turning now to FIG. 1, indicated generally at 10 is a schematic diagram illustrating electronic gaming machines (EGMs), like EGMs 12, 14, interconnected by a computer network. Included therein are three banks, indicated generally at 16, 18, 20, of EGMs. Each EGM is connected via a network connection, like connection 22, to a bank controller 24. In the present embodiment of the invention, each bank controller comprises a processor that facilitates data communication between the EGMs in its associated bank and the other components on the network. The bank controller also includes a CD ROM drive for transmitting digitized sound effects, such as music and the like, to a speaker 26 responsive to commands issued over the network to bank controller 24. The bank controller is also connected to an electronic sign 28 that displays information, such as jackpot amounts and the like, visible to players of machines on bank 16. Such displays are generated and changed responsive to commands issued over the network to bank controller 24. Each of the other banks 18, 20 of EGMs include associated bank controllers, speakers, and signs as shown, which operate in substantially the same manner.

Ethernet hub 30 connects each of the bank controllers associated with banks 16, 18, 20 of EGMs to a concentrator 32. Another Ethernet hub 34 connects similar bank controllers (not shown), each associated with an additional bank of EGMs (also not shown), to concentrator 32. The concentrator functions as a data control switch to route data from each of the banks to a translator 36. The translator comprises a compatibility buffer between the concentrator and a proprietary accounting system 38. It functions to place all the data gathered from each of the bank controllers into a format compatible with accounting system 38. The present embodiment of the invention, translator 38 comprises an Intel Pentium 200 MHz Processor operating Microsoft Windows NT 4.0.

Another Ethernet hub 39 is connected to a configuration workstation 40, a player server 42, and to bonus servers 44, 46. Hub 39 facilitates data flow to or from workstation 40 and servers 42, 44, 46.

The configuration workstation 40 comprises a personal computer including a keyboard, Intel Pentium Processor, and Ethernet card. It is the primary user interface with the network.

The player server 42 comprises a microcomputer that is used to control messages that appear on displays associated with each EGM. Player server 42 includes an Intel Pentium Processor and an Ethernet card.

Bonus servers 44, 46 each comprise a microcomputer used to control bonus applications on the network. Each bonus application comprises a set of rules for awarding jackpots in excess of those established by the pay tables on each EGM. For example, some bonus awards may be made randomly, while others may be made to linked groups of EGMs operating in a progressive jackpot mode. Examples of bonuses that can be implemented on the network are disclosed in co-owned U.S. Pat. No. 6,319,125 (the '125 patent), which is incorporated herein by reference for all purposes. The '125 patent also describes in more detail features of the network, like that shown in FIG. 1, that may be used to implement the present invention. The '961 patent also discloses bonuses that can be implemented by bonus servers 44, 46 and a network that could be used to implement the present invention.

As used herein the term jackpot indicates an award made resulting from the pay table on one of the EGMs while the term bonus indicates an award that does not result from the machine's pay table. The '125 patent and '961 patent include many examples of bonuses. The term award is intended to encompass any payment given to a player of one of the EGM's and includes both jackpots and bonuses.

Figure 2:
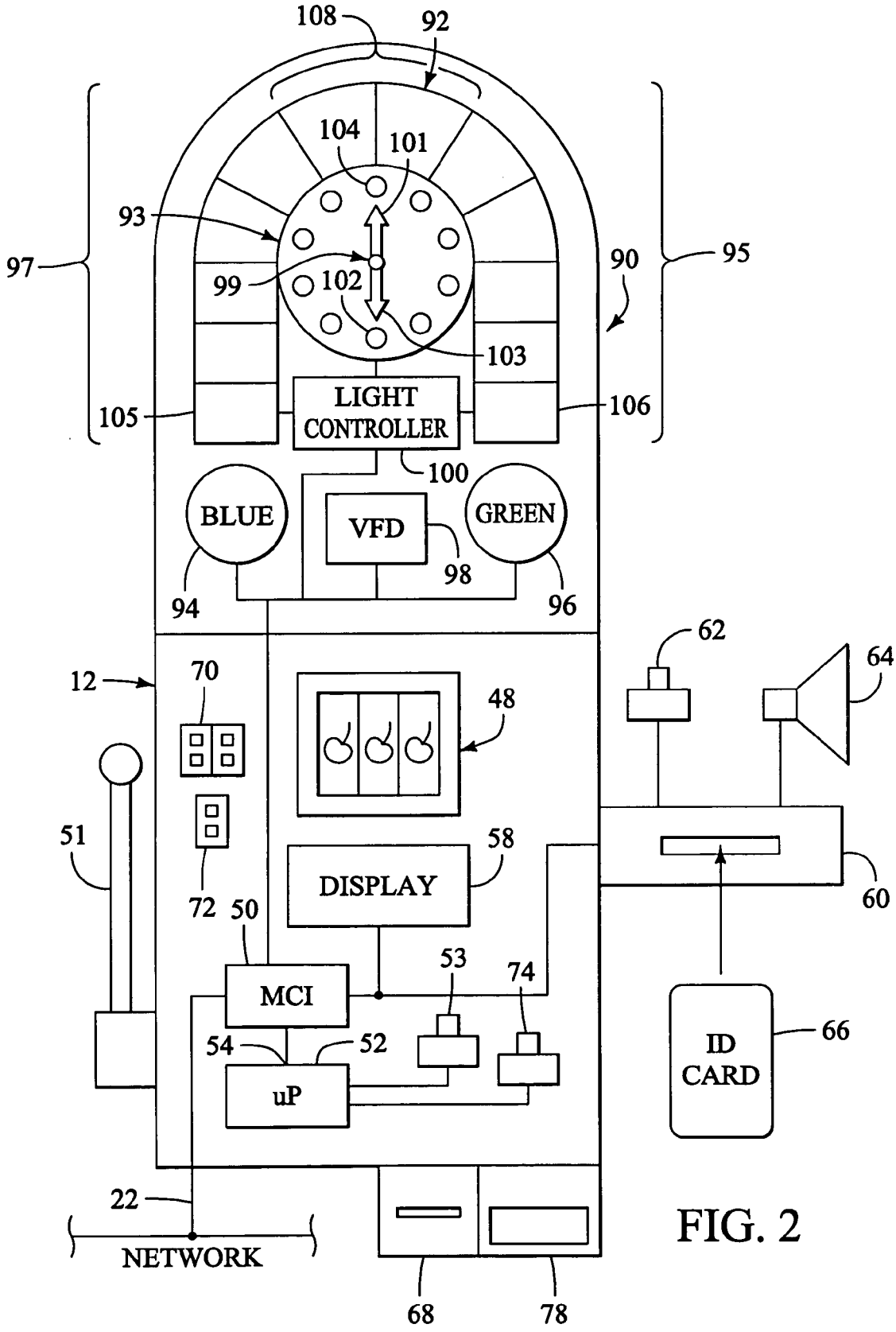
FIG. 2 is a schematic diagram of a slot machine and associated hardware, including the top box secondary game constructed in accordance with a preferred embodiment of the invention.

FIG. 2 illustrates a gaming machine 12 constructed according to a preferred embodiment of the invention. Included is a highly schematic representation of an electronic slot machine—typical of each of the machines in the network—that incorporates network communications hardware as described hereinafter. This hardware is described in the '961 patent, and is referred to therein as a data communications node. Preferably the network communications hardware is like that disclosed in the '125 patent, namely a machine communication interface (MCI) 50.

MCI 50 facilitates communication between the network, via connection 22, and microprocessor 52, which controls the operation of EGM 12. This communication occurs via a serial port 54 on the microprocessor to which MCI 50 is connected.

Included in EGM 12 are three reels, indicated generally at 48. Each reel includes a plurality of different symbols thereon. The reels spin in response to a pull on handle 51 or actuation of a spin button 53 after a wager is made. One or all of the reels 48 may include a special bonus initiator symbol which, when obtained on the gaming machine's payline, will cause the MCI 50 to initiate the secondary bonus game, which is operated according to methods discussed further below.

MCI 50 includes a random access memory (RAM), which can be used as later described herein. The MCI also facilitates communication between the network and a vacuum florescent display (VFD) 58, a card reader 60, a player-actuated push button 62, and a speaker 64.

Before describing play according to the invention, description will first be made of typical play on a slot machine, like EGM 12. A player plays EGM 12 by placing a wager and then pulling handle 51 or depressing spin button 53. The wager may be placed by inserting a bill into a bill acceptor 68. A typical slot machine, like EGM 12, includes a coin acceptor 80 (FIG. 3) that may also be used by the player to make a wager. A credit meter 70 is a numeric display that indicates the total number of credits available for the player to wager. The credits are in the base denomination of the machine. For example, in a nickel slot machine, when a five-dollar bill is inserted into bill acceptor 68, a credit of 100 appears on credit meter 70. To place a wager, the player depresses a coin-in button 82 (FIG. 3), which transfers a credit from the credit meter 70 to a coin-in meter 72. Each time the button is depressed a single credit transfers to the coin-in meter up to a maximum bet that can be placed on a single play of the machine. In addition, a maximum-bet button 84 (FIG. 3) may be provided to immediately transfer the maximum number of credits that can be wagered on a single play from the credit meter 70 to the coin-in meter 72.

When coin-in meter 72 reflects the number of credits that the player intends to wager, the player depresses spin button 53 thereby initiating the base game.

The player may choose to have any jackpot won applied to credit meter 70. When the player wishes to cash out, the player depresses a cash-out button 74, which causes the credits on meter 70 to be paid in coins to the player at a hopper 78, which is part of machine 12. The machine consequently pays to the player, via hopper 78, the number of coins—in the base denomination of the machine—that appear on credit meter 70.

Card reader 60 reads a player-tracking card 66 that is issued by the casino to individual players who choose to have such a card. Card reader 60 and player-tracking card 66 are known in the art, as are player-tracking systems, examples being disclosed in the '961 patent and '125 patent. Briefly summarizing such a system, a player registers with the casino prior to commencing gaming. The casino issues a unique player-tracking card to the player and opens a corresponding player account that is stored on accounting system 38 (in FIG. 1). Accounting system 38 is referred to herein as a host computer. It should be appreciated, however, that the host computer can be distributed on the network and could include multiple processors or memories. The account includes the player's name and mailing address and perhaps other information of interest to the casino in connection with marketing efforts. Prior to playing one of the EGMs in FIG. 1, the player inserts card 66 into reader 60 thus permitting accounting system 38 to track player activity, such as amounts wagered and won and rate of play.

To induce the player to use the card, the casino awards each player points proportional to the money wagered by the player. Players consequently accrue points at a rate related to the amount wagered. The points are displayed on display 58. In prior art player tracking systems, the player may take his or her card to a special desk in the casino where a casino employee scans the card to determine how many accrued points are in the player's account. The player may then redeem points for selected merchandise, meals in casino restaurants, or the like, which each have assigned point values.

Figure 3:
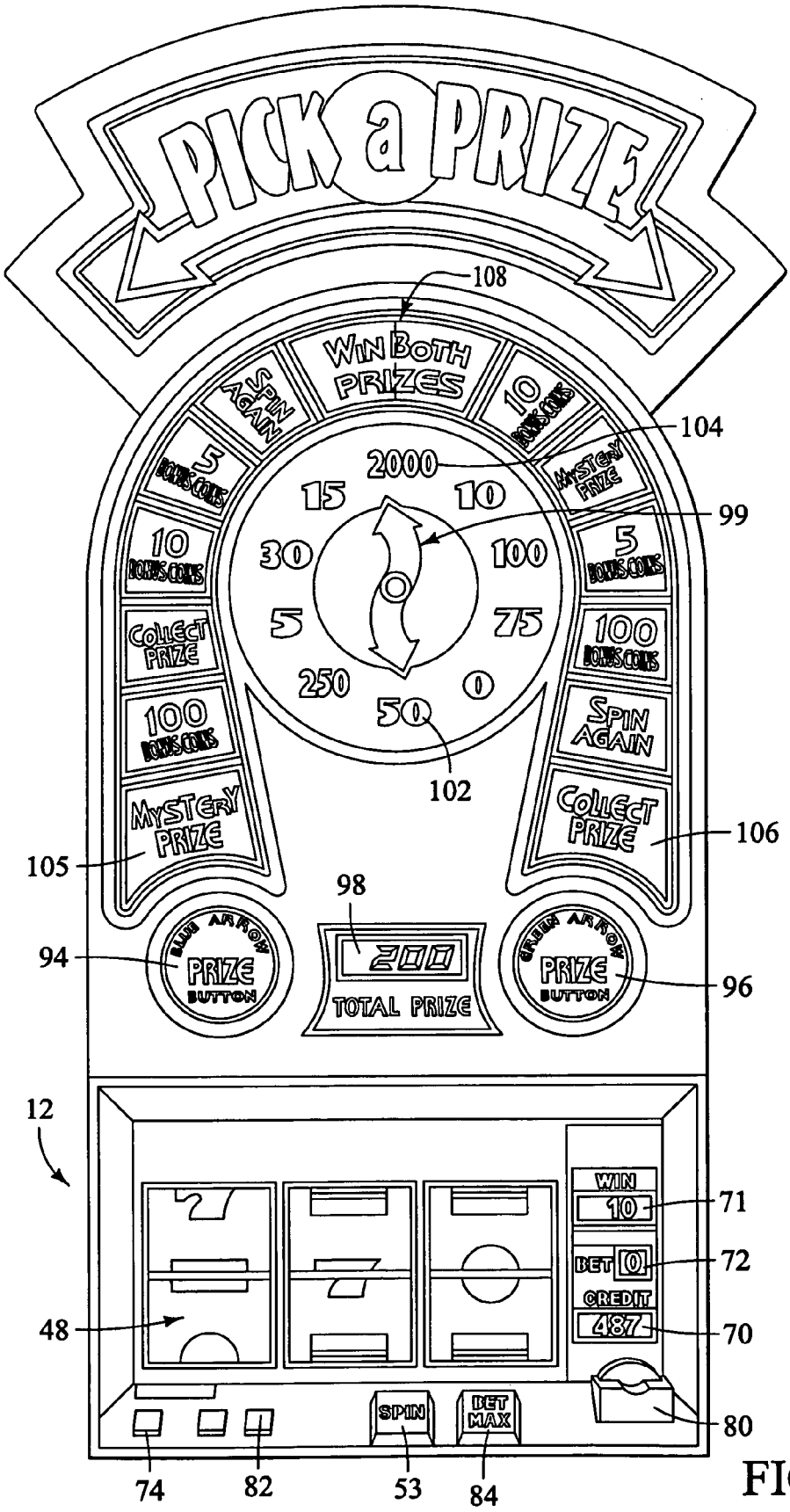
FIG. 3 is a pictorial view of the top box playing field displaying the secondary game implemented using the apparatus shown in FIG. 2.

Referring also to FIG. 3, the electronic gaming machine 12 constructed according to a preferred embodiment of the invention includes a Bally S5500/S6000 upright slot machine, which is the base game, with the top box removed. The top box is replaced with a top box 90 customized to implement a secondary, bonus game according to the present invention. The top box 90 includes a display playing field 92, a pair of buttons, including "blue" button 94 and "green" button 96, and a VFD 98 intended to display the bonus credits accumulated by playing the secondary bonus game. The top box also includes a bonus and light controller 100 that interfaces with MCI 50 to drive the light display pattern of the top box 90 in attract mode and bonus play mode.

Display playing field 92 includes a spinner section 93, and a pair of columns of light cans 95, 97 flanking the spinner. In the preferred embodiment of the invention, the spinner section 93 includes a mechanical spinner 99 having two pointed ends 101, 103 of blue and green colors that correspond to blue and green buttons 94, 96 respectively. The pointer is produced from a fluoroplastic that glows from light passed through the white background against which the pointer spins.

In use, the mechanical spinner rotates on an axis in the middle of spinner section 93 and, under the control of MCI 50, stops at one of ten different locations, such as bonus spots 102, 104, each having a different numerical value associated with it. As shown in FIG. 3, there are a total of ten possible bonus spots within the spinner section 93, with bonus spot 102 corresponding to a bonus of 50 credits and bonus spot 104 corresponding to a bonus of 2000 credits. Other bonus spots vary in value between zero additional bonus credits and 250 but it is understood that the values chosen are typically selected mathematically so that the payback percentage is in the casino's favor. As there are two pointed ends to spinner 99, the bonus spot selected is based upon whether the blue button 94 or the green 96 is selected by the player prior to when the spinner stops.

The left side of the top box 90 is the "blue" side and includes the blue light can column 97 with multiple bonus prizes, such as that shown in prize space 105, one of which is automatically "selected" as described below after the spinner stops rotating and is awarded as an enhancement or supplemental bonus to the spinner bonus prize.

The right side of the top box 90 is the "green" side and operates with green light can column 95 having multiple supplemental bonus prizes, such as prize space 106, one of which is automatically "selected" after the spinner stops rotating. The top two positions 108 of each column are shared by both the green and blue side and result, if selected, in the super bonus prize discussed below.

Figure 4:
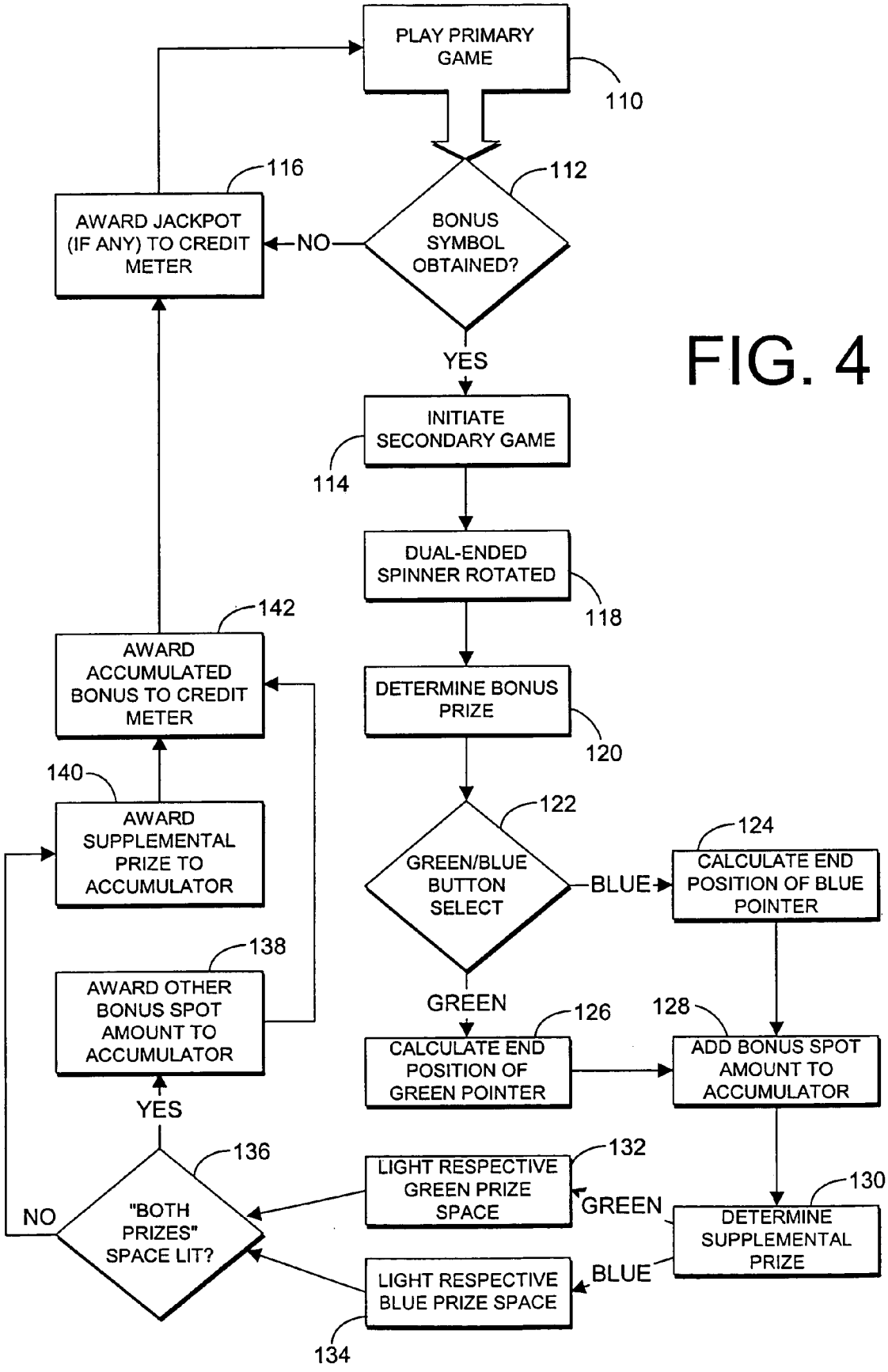
FIG. 4 is a flow chart that depicts the operation of the FIG. 3 secondary game in accordance with a preferred embodiment of the present invention.

FIG. 4 is a flow diagram showing the operation of the game practiced according to a preferred embodiment of the invention. The primary concept behind the game is to give the player the opportunity to select one end (color) of a two-headed pointer to give the player at least the simulated feeling of control over the bonus prize amount awarded during the bonus game.

Play is commenced at the primary base game in block 110. In the slots embodiment shown, a player inserts coins into coin slot 80 or plays accumulated credits from a player credit account and presses the spin button 53 or pulls the slot machine handle 51 to start the turn of the three reels 48. If a bonus initiator symbol is obtained in block 112, then the method proceeds to block 114 in which the bonus game is initiated. It is also contemplated that the player must qualify in order to be eligible to proceed to block 114. Examples include: played max coin, is playing at a particular rate, the identity of the player, etc.

If no bonus initiator symbol is obtained, then the method proceeds to block 116 where any jackpot obtained by play of the base game three reels according to a pay table stored in the gaming machine is awarded to the player. Play of the primary game then commences in block 110.

At initiation of the secondary game in block 114, the MCI 50 instructs the spinner 99 in block 118 to begin spinning within spinner section 93 so that as the spinner moves around the circle it points to consecutively lit bonus spots 102, 104. Concurrent with this process, the MCI 50 determines a bonus prize from a pay table stored within MCI 50 that corresponds to one of the bonus spots 102, 104—either 0, 5, 10, 15, 30, 50, 75, 100, 250, or 2000 bonus credits. MCI also instructs light controller 100 to flash lights behind buttons 94, 96 as a prompt to the player to hit either the green or blue button. Upon player selection of the blue button 94 or green button 96 in block query 122, a respective column of light cans 95, 97 is lit up by light controller 100 to indicate the color selected. The choice of color also determines which end 101, 103 of spinner 99 is active to yield a particular bonus prize.

Since the bonus prize is selected by the MCI 50 (step 120) from a bonus pay table stored in the MCI prior to the color selection (step 122) by the player, an end position of the spinner 99 must be calculated after the player's color selection step. End positions of the spinner 99 is calculated in blocks 124 or 126 depending upon which color is selected. That is, if the MCI 50 determines that a 50 credit bonus prize is to be won in the bonus session, the correct spinner end 101 or 103 must point at the correct bonus spot. In the case where the pointer ends are opposite one another such as that shown in FIGS. 2 and 3, a calculation for an end position can be made for the blue pointer end 101 to point at the 50 credit bonus spot. If "blue" is selected by the player, then the spinner mechanism can operate according to the rotational characteristics calculated. If "green" is selected by the player instead, then the spinner mechanism rotates the end position by an additional 180 degrees so that the green pointer end 103 (and not blue pointer end 101) points to the 50 credit bonus spot.

The player is given the illusion that he or she controls which bonus prize is won since the green side of the pointer will point to a different bonus prize than the blue side. In fact, however, the prize won is determined immediately after the bonus period begins and before the color selection button is pressed based upon a weighted pay table. Only after the color button is pressed is the exact position of the spinner determined.

For example, a player enters the bonus period and the game electronics determines that the bonus prize won is for 20 coins. This amount is not yet communicated to the player. Instead, the player is given an audible and visual prompt to press either the blue or green button as the pointer spins. The final position of the pointer cannot yet be determined by the machine since the correct side of the pointer must end up facing the "20 coin" win space. When the player chooses a color, the final position of the pointer is determined and the spinner slows down until the correct end of the pointer stops on that position. The amount shown on the bonus spot selected is added in block 128 to the accumulator shown in the VFD display 98.

When the pointer has stopped spinning, the supplementary prize phase begins in block 130. Each space of the selected light can column is sequentially highlighted until one is randomly chosen and the appropriate prize (and spinner bonus prize) is awarded to the player in blocks 132, 134 depending upon which color the player had chosen at the onset of the bonus game in block 122. If one of the top two spaces 108 on the column is lit in block 136, the bonus amounts from both the green and blue pointer 101, 103 are awarded to the player in block 138. The bonus spot not added to the accumulator in block 128 is thus now added to the amount shown in VFD display 98. If the supplemental prize space selected is not one of the special spaces 108, the play proceeds to block 140 where the amount of the space—either 0 ("collect prize"), 5, 10, or 100 bonus credits, a "mystery prize", or "spin again"—is accumulated in VFD display 98 and awarded to the players credit meter in block 142. The bonus and any jackpot are awarded to the machine credit meter 71 (FIG. 3) and thence to the player credit meter 70 in block 116. Regular play on the primary base game then commences in block 110.

Having described and illustrated the principles of the invention in a preferred embodiment thereof, it should be apparent that the invention can be modified in arrangement and detail without departing from such principles. The inventive concept herein is intended to broadly encompass the implementation of a game having two or more prize selection means (e.g. each end of the double-ended pointer) where a player would then chose which selection means is operable to chose the bonus prize. We thus claim all modifications and variations coming within the spirit and scope of the following claims.

We claim:

1. A gaming device comprising:

a spinner characterized by a two-ended pointer, each end of the two-ended pointer pointing in a different direction than the other end, rotating within a field of bonus prizes, and stopping at a designated position within the field;

a selector enabling a choice of one of the ends of the two-ended pointer while the spinner is rotating within the field of bonus prizes; and prize awarding means for providing a winning payout responsive to the designated position at which the selected end of the two-ended pointer stops.

2. The gaming device of claim 1, wherein the ends of the pointer are fixed relative to one another.

3. The gaming device of claim 2, wherein each end of the two-ended pointer is oriented 180 degrees from one another so that they point in opposite directions from one another.

4. The gaming device of claim 1, wherein the selector includes two buttons with each button associated with a particular end of the pointer.

5. The gaming device of claim 1, wherein the spinner is mechanical rotating about an axis under control of processor.

6. The gaming device of claim 1, further including a bonus feature providing a winning bonus payout associated with both ends of the pointer.

7. A method for implementing a game on an electronic gaming machine comprising the steps of:

(a) allowing play to occur on a base game of the gaming machine;

(b) initiating a bonus game on the gaming machine responsive to play on the gaming machine base game, said bonus game including two selectors comprising different ends of a two-ended spinner, where each selector is visually associated with a plurality of bonus prizes of the bonus game;

(c) enabling player choice of one of the selectors;

(d) associating the chosen selector with one of the plurality of bonus prizes; and (e) awarding the determined one of the bonus prizes associated with the chosen selector.

8. The method of claim 7 further including the steps of:

determining a bonus prize prior to step (c); and manipulating the chosen selector in step (d) so that the chosen selector is associated with the determined bonus prize.

9. The method of claim 7 further including the steps of:

determining player eligibility for the bonus game prior to step (b); and initiating the bonus game only if player eligibility is satisfied.

10. The method of claim 9, wherein player eligibility is satisfied if the player plays a maximum bet on the base game.

11. The method of claim 9, wherein player eligibility is satisfied if the player is playing the base game at a particular rate of play.

12. The method of claim 7, further including:

identifying the player; and initiating the bonus game responsive to the player identification.

13. The method of claim 7, wherein the selectors move among a single field of visually fixed bonus prizes.

14. A method for implementing a game on a gaming device, the method comprising:

allowing play to occur on a base game of the gaming device;

initiating a bonus game on the gaming device responsive to a bonus triggering event, the bonus game including two selectors each corresponding to a different end of a two-ended spinner rotating within a field of bonus prizes;

allowing a player to chose one of the selectors;

associating the spinner end corresponding to the chosen selector with one of the bonus prizes in the field of bonus prizes after the player has chosen one of the selectors; and awarding the bonus prize associated with the spinner end corresponding to the chosen selector.

15. The method of claim 14, further comprising:

determining which of the bonus prizes in the field of bonus prizes to award to the player prior to allowing the player to chose one of the selectors; and associating the spinner end corresponding to the chosen selector with the determined bonus prize.

16. The method of claim 14, further comprising adding a supplementary prize determined during a supplementary prize phase after the spinner end has been associated with one of the bonus prizes to the associated bonus prize and awarding the sum of the supplementary prize and the associated bonus prize.

17. The method of claim 16, wherein the supplementary prize includes the bonus prize associated with the spinner end that does not correspond to the chosen selector.

* * * * *